US005090569A

United States Patent [19]

Nissen et al.

[11] Patent Number: 5,090,569

[45] Date of Patent: Feb. 25, 1992

[54] PACKAGE

[76] Inventors: Michael Nissen; Marianne Zerlang, both of Paltholmterrasserne 36 F, 3520 Farum, Denmark

[21] Appl. No.: 704,081

[22] Filed: May 22, 1991

[51] Int. Cl.[5] ..... B65D 85/00

[52] U.S. Cl. ..... 206/457; 206/805; 446/487; 446/486; 446/310

[58] Field of Search ..... 206/457, 423, 486, 493, 206/805; 446/487, 486, 310, 241; 267/150, 153

[56] References Cited

U.S. PATENT DOCUMENTS

| | | | |
|---|---|---|---|
| 503,387 | 8/1893 | Schofield | 446/487 X |
| 769,935 | 9/1904 | Brom | 446/310 X |
| 1,195,938 | 8/1916 | Andreas | 446/241 |
| 3,688,435 | 9/1972 | Sapkus et al. | 446/310 |
| 4,248,347 | 2/1981 | Trimbee | 206/423 |

*Primary Examiner*—Paul T. Sewell
*Assistant Examiner*—Jacob K. Ackun, Jr.
*Attorney, Agent, or Firm*—Larson and Taylor

[57] ABSTRACT

A reusable packaging device is provided which is in the nature of a joke or novelty item or advertising article. The device includes an outer shell assembly in which an object to be packaged can be housed prior to use thereof or during interruptions in that use. This shell assembly includes a plurality of shell parts which, in the closed position thereof, surround the object. An elongate support member supports the shell assembly and the object. The shell parts are hinged at one end thereof to the support member so that said shell parts can pivot between a closed position in which the shell parts surround and enclose the object, and an opened position wherein the object is revealed. A rubber band secured to hooks formed on each of the shell parts biases the shell parts toward the support member so as to tend to maintain the shell parts in the positions to which shell parts are moved, i.e., to hold the shell parts either opened or closed.

11 Claims, 3 Drawing Sheets

PACKAGE

FIELD OF THE INVENTION

The present invention generally relates to packages or items or articles with outer coverings and, more particularly, to a novelty item or advertising article in the nature of a package wherein when the item or article is "opened," the inner contents thereof are revealed.

BACKGROUND OF THE INVENTION

Novelty or joke items used as favors or gifts, in advertising or for other similar purposes are generally most effective when they provide an element of surprise. Other important factors that must be considered in producing a successful item of this type include complexity and cost. Thus, such items should be relatively simple and inexpensive to make and relatively sturdy or robust s that they do not readily break or fall apart. Problems are encountered in attempting to provide an item of this type which affords such an element of surprise and which also meets the other requirements set forth above.

SUMMARY OF THE INVENTION

In accordance with the invention, a packaging device is provided which is reusable and which, according to one aspect thereof, enables an object or item to be stored or housed prior to use. Although not limited to such an application, the invention is chiefly useful as a novelty item, e.g., a party favor or a gift, and, in this regard, provides the element of surprise referred to above by, when opened, revealing an item or figure that, together with the opened device itself, simulates something else. For example, the simulation can be of a living thing, such as, referring to the two specific examples discussed below, a flower and its leaves or a monkey or like figure in a "palm tree." It will be understood that the invention is not limited to simulating these particular objects or figures and that, more generally, the invention can be used as a storage or packaging device for various items such as a ring or other jewelry and the like.

In accordance with the invention, a reusable packaging device is provided which is in the nature of a joke or novelty item or advertising article, the device comprising an outer shell assembly in which an object to be packaged can be housed prior to use thereof or during interruptions in that use. The shell assembly includes at least two shell parts which, in the closed position thereof, surround the object, and device further comprises an elongate support member on which the shell assembly is mounted along with the object, hinge means for pivotably connecting the shell parts at one end thereof to the support member so that the shell parts can pivot between a first, closed position in which the shell parts surround and enclose the object and a second, open position, and resilient means secured to said shell parts for biassing said shell parts toward said support member so as to tend to maintain the shell parts in the first position when the shell parts are moved to the first position and to maintain the shell parts in the second position when the shell parts are moved to said second position.

Advantageously, the device is rotationally symmetrical with respect to the longitudinal axis of the elongate support member.

Preferably, the resilient means comprises an elastic band and the shell parts each include a hook affixed to the inside surface thereof to which the resilient band is secured.

In a preferred embodiment, the width of each shell part varies between the ends thereof. Further, the width of each shell part is preferably greatest intermediate between these ends.

The diameter of the elongate support member is preferably greater at the end thereof on which said shell assembly is mounted than at the opposite end thereof. Advantageously, the elongate support member is tapered between the ends thereof.

Other features and advantages of the invention will be set forth in, or apparent from, the detailed description of preferred embodiments of the invention which follows.

DESCRIPTION OF THE PREFERRED EMBODIMENTS

Figure 1:
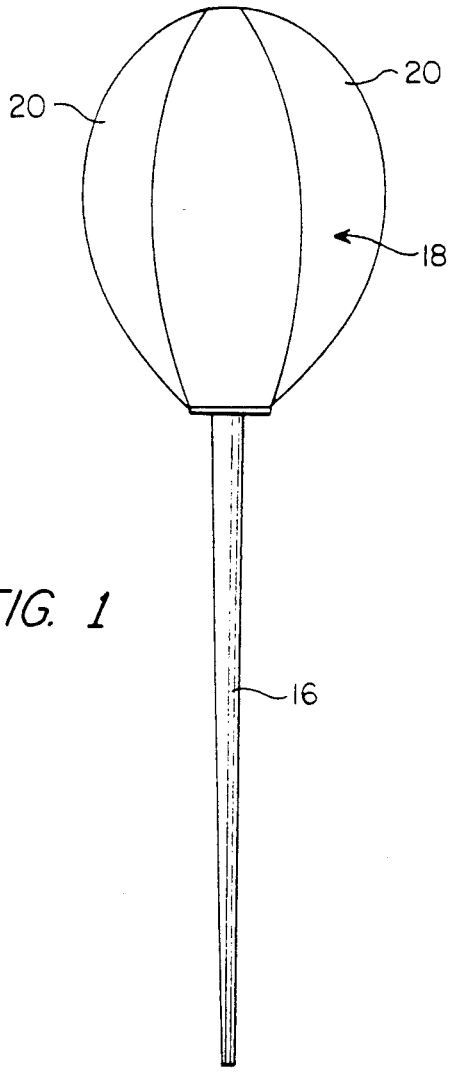
FIG. 1 is a side elevational view of a packing device on accordance with a first embodiment of the invention, in the closed state thereof.
Figure 2:
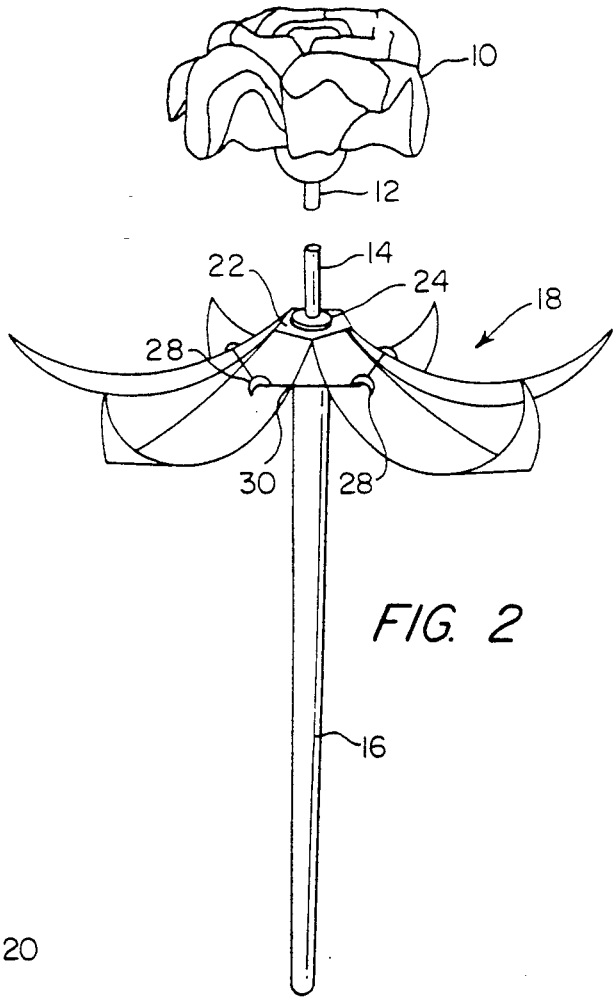
FIG. 2 is an exploded perspective view of the device of FIG. 1, showing the opened state of the device and illustrating an item stored therein or thereby.

Referring to FIGS. 1 to 6, a packaging device in accordance with a first embodiment of the invention is shown. As discussed above, the invention, while serving as a reusable package, is also in the nature of a novelty item and in this embodiment, the item being stored cooperates with device itself to complete the novelty item. More specifically, as illustrated in FIG. 2, an artificial flower 10 including a downwardly depending tube 12 in the nature of a "stem," is mounted on an upwardly extending mounting post or upright support 14 of an elongate support member 16. A shell assembly 18 mounted on support member 16 and described in more detail below, when opened as illustrated in FIG. 2 (and in FIGS. 5 and 6) resembles or simulates the leaves of a flower, thus contributing to the overall appeal of the device.

Figure 3:
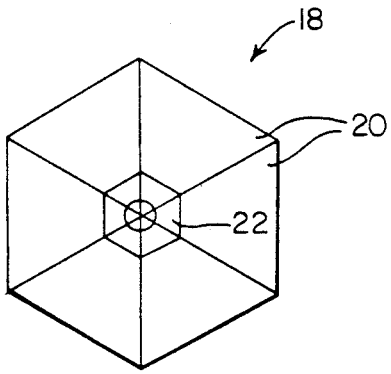
FIG. 3 is a bottom plan view of the shell assembly of the device of FIG. 1, showing the device in the closed state thereof.
Figure 4:
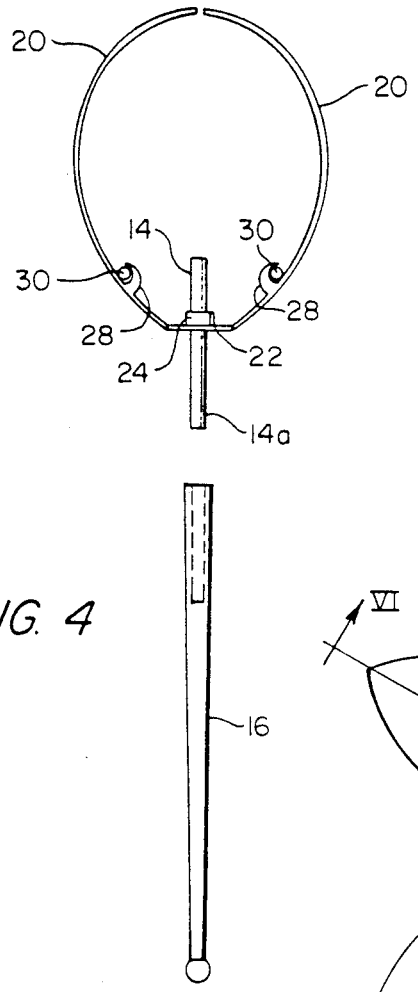
FIG. 4 is an exploded side elevational view of the device of FIG. 1, showing the device in the closed state thereof.
Figure 5:
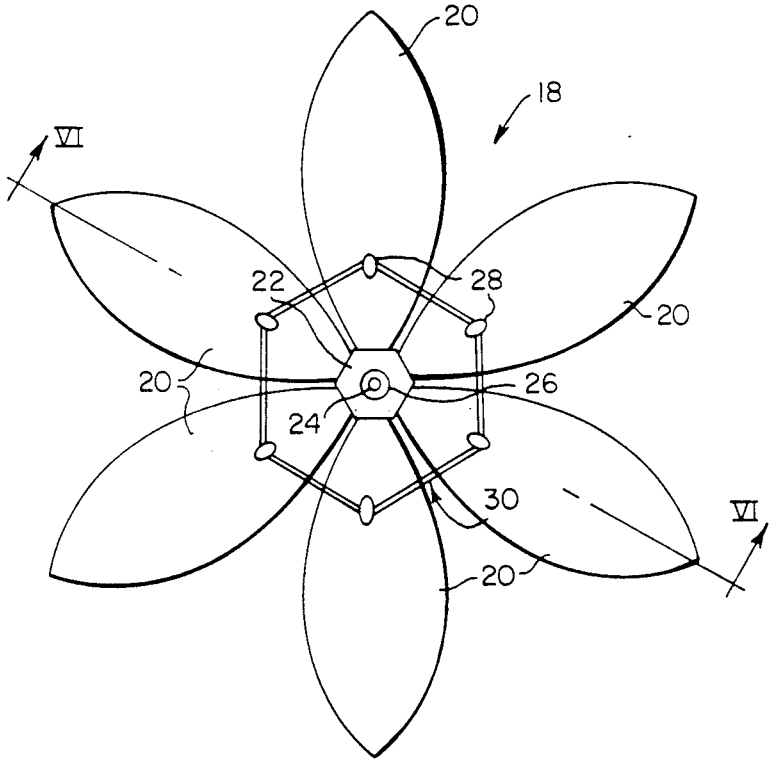
FIG. 5 is a top plan view of the device of FIG. 1, showing the device in the opened state thereof.
Figure 6:
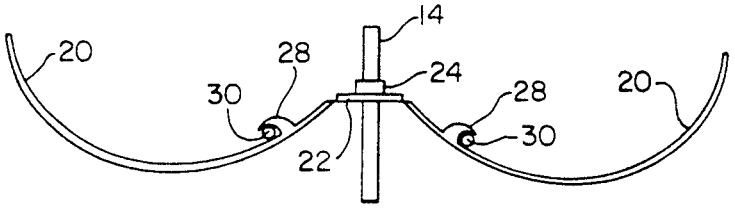
FIG. 6 is a simplified cross sectional view taken generally along line VI—VI of FIG. 5.

Turning now to a consideration of the shell assembly 18, the assembly is shown in the closed state thereof in FIGS. 1, 3 and 4, and in the opened state thereof in FIGS. 2, 5 and 6, and, as illustrated, comprises a plurality of shell parts 20 which are, in the illustrated embodiment, of a petal shape (i.e., roughly elliptical) in plan and of a roughly semicircular shape in cross section. As a result, when in the closed position thereof, the shell parts 20 form a complete, shell-like enclosure, as illustrated. The shell assembly 18 further includes a hexagonal base 22 (perhaps best seen in FIG. 3) to which the shell parts or petals 20 are hinged, e.g., by simple plastic hinges. Base 22 includes an upper hub portion 24 and a central opening 26 through which mounting post 14 extends.

In the illustrated embodiment, the elongate support member 16 includes a longitudinal opening 16*a* in the upper end thereof, and an oppositely extending, i.e., downwardly depending, extension 14*a* of mounting port 14 is received in opening 16*a* and affixed to member 16, e.g., by gluing. It will be appreciated that base 22, hub 24, port 14 and extension 14*a* can all be of an integral one piece molded construction, together with shell parts 20.

Shell parts 20 each include a hook portion 28 affixed to, or formed integrally on, the inside surface of the corresponding part as can best be seen in FIGS. 2, 4, 5 and 6. An endless resilient member 30, such as an elastomeric loop (e.g., a rubber band), is stretched so as to extend around the hooks as shown in FIGS. 2 and 5, and thus so as to exert a biassing force which tends to hold the shell parts in the closed position thereof (as shown, e.g., in FIG. 4) when the shell parts are brought to that position. This biassing force also tends to hold the shell parts in the opened position thereof when the shell parts 18 are peeled back manually from the closed position to the opened position wherein the shell parts 18 extend generally radially outwardly from hub 22 (as illustrated, e.g., in FIG. 2, 5 and 6).

It will be appreciated from the foregoing that, in the use of the device of FIGS. 1 to 6, the shell assembly 18 can be closed by, referring to FIGS. 4 and 6, urging the shell parts 18 upwardly past the opened position shown in FIG. 6 so that the parts 18 are drawn closed by resilient loop 30. Similarly, by peeling the shell parts 18 back and causing them to rotate or pivot backwardly against the biassing force of resilient loop 30 to the radial extending position shown in FIG. 6, resilient loop 30 will also act to hold the shell parts 18 in this opened position.

Figure 7:
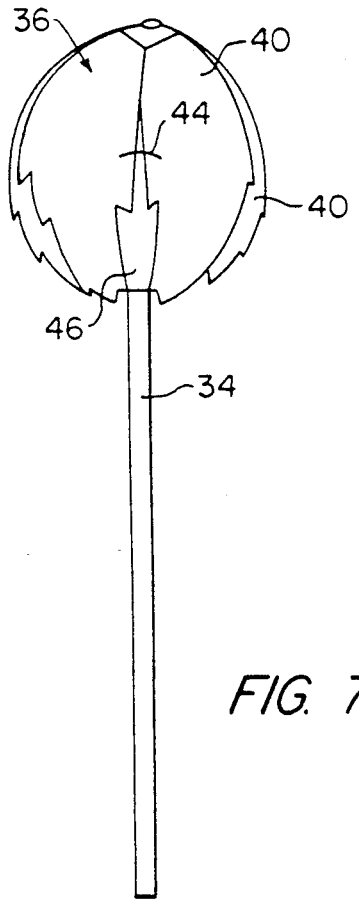
FIG. 7 is a side elevational view of a device constructed in accordance with a second preferred embodiment of the invention, showing the device in the closed state thereof.
Figure 8:
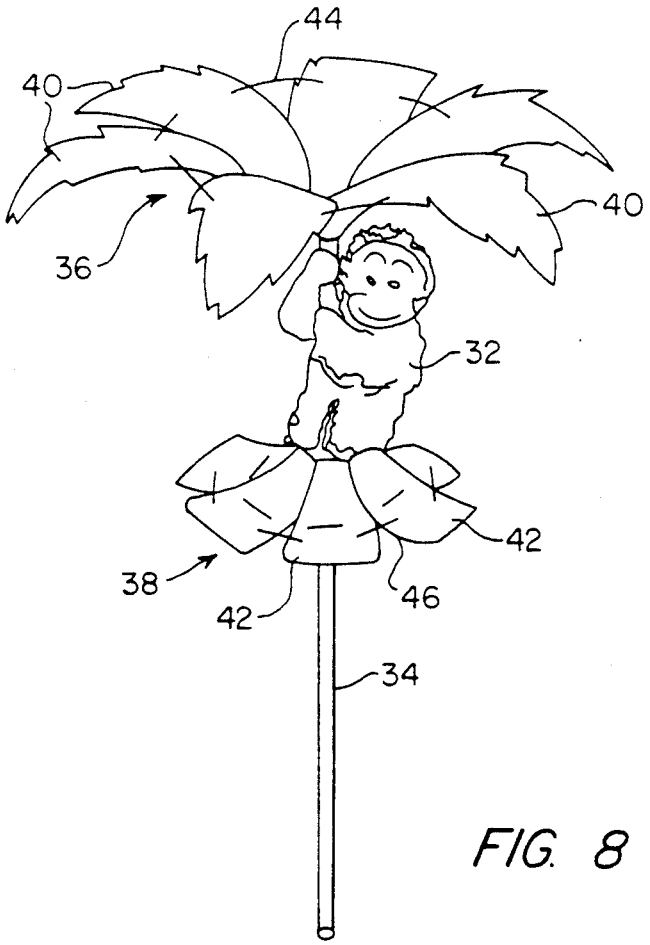
FIG. 8 is a perspective view of the device of FIG. 7, showing the device in the opened state thereof.

Referring to FIGS. 7 and 8, a second embodiment of the invention is shown which is even more in the nature of a novelty item. In this embodiment, a monkey FIG. 32 is mounted on the end of an elongate support member 34 and upper and lower shell assemblies 36 and 38 are provided. The former is made up of a plurality of shell parts 40 which are constructed so as to resemble palm leaves or fronds and the latter is made up of further shell parts 42 which form a base of leaves or the like, as illustrated. A first resilient band 44 extends through shell parts 40 serves to bias these parts into either an open or closed position as described above while a second resilient band 46 extends through shell parts 42 and serves a similar function. The closed positions of the shell parts 40 (and to some extent those of shell parts 38) are shown in FIG. 7.

The operation of the embodiment of FIGS. 7 and 8 is somewhat similar to that of FIGS. 1 to 6, except that upper shell assembly 36 is "upside down." The monkey figure 32 is revealed by peeling or pivoting shell members 40 upwardly and thereafter peeling or pivoting shell members 42 downwardly, so that the shell parts or members 40 and 42 assume the positions illustrated in FIG. 8.

Although the present invention has been described relative to specific exemplary embodiments thereof, it will be understood by those skilled in the art that variations and modifications ca be effected in these exemplary embodiments without departing from the scope and spirit of the invention.

What is claimed is:

1. A reusable packaging device in the nature of a joke or novelty item or advertising article, said device comprising an outer shell assembly in which an object to be packaged can be housed prior to use thereof or during interruptions in that use, said shell assembly including at least two shell parts which, in the closed position thereof, surround the object, an elongate support member on which said shell assembly is mounted and including means for supporting the object, hinge means for pivotably connecting said shell parts at one end thereof to said support member so that said shell parts can pivot between a first, closed position in which the shell parts surround and enclose the object and a second, open position, and resilient means secured to said shell parts for biassing said shell parts toward said support member so as to tend to maintain said shell parts in said first position when said shell parts are moved to said first position and to maintain said shell parts in said second position when said shell parts are moved to said second position.

2. A device as claimed in claim 1 wherein said device is rotationally symmetrical with respect to the longitudinal axis of said elongate support member.

3. A device as claimed in claim 1 wherein said resilient means comprises an elastic band and said shell parts each include a hook affixed to the inside surface thereof to which said resilient band is secured.

4. A device as claimed in claim 1 wherein the width of each shell part varies between said one end and the other end of the shell part.

5. A device as claimed in claim 4 wherein the width of each shell part is greatest intermediate between said one end and said other end.

6. A device as claimed in claim 1 wherein said resilient means comprises an elastic band secured to said shell parts.

7. A device as claimed in claim 1 wherein the diameter of said elongate support member is greater at the end thereof on which said shell assembly is mounted than at the opposite end thereof.

8. A device as claimed in claim 7 wherein the elongate support member is tapered between the ends thereof.

9. An openable novelty device which, when opened, reveals a normally hidden object contained with the device, said device comprising:

an elongate support member;

a shell assembly in which an object is housed, said shell assembly comprising a plurality of shell parts which, when the device is closed, envelope the object so that the object is hidden from view; and means for mounting said shell assembly on one end of said elongate support member;

said shell assembly further comprising a base on which the object is mounted, hinge means for hingedly connecting said shell parts at one end thereof to said base so that said shell parts can pivot between a first, closed position in which said shell parts envelope the object and a second, opened position wherein the object is revealed, and resilient means, releasably secured to said shell parts for biassing said shell parts toward said support member so as to tend to maintain said shell parts in said first, closed position when said shell parts are moved to said first, closed position and to maintain said shell parts in said second, opened position when said shell parts are moved to said second, opened position.

10. A device as claimed in claim 9 wherein said object is an artificial flower and said shell parts are shaped so as to simulate the petals of a flower.

11. A device as claimed in claim 9 wherein said object is an animal figure and said shell parts are shaped so as to simulate the leaves of a tree.

* * * * *